US012158092B1

(12) United States Patent
Dunn et al.

(10) Patent No.: US 12,158,092 B1
(45) Date of Patent: Dec. 3, 2024

(54) EXHAUST SYSTEM WITH A DEHYDRATION SUBSYSTEM UPSTREAM OF CARBON CAPTURE MEDIA

(71) Applicant: Enhanced Energy Group LLC., West Kingston, RI (US)

(72) Inventors: Paul M. Dunn, West Kingston, RI (US); Barry Drake Lawson, Houston, TX (US); Behnam Fakhari Kisomi, Houston, TX (US); Garett Paul Lambert, Houston, TX (US); Darius Remesat, Calgary (CA); Ian Glen Buchanan, Calgary (CA)

(73) Assignee: Enhanced Energy Group LLC, West Kingston, RI (US)

( * ) Notice: Subject to any disclaimer, the term of this patent is extended or adjusted under 35 U.S.C. 154(b) by 0 days.

(21) Appl. No.: 18/538,639

(22) Filed: Dec. 13, 2023

(51) Int. Cl.
*F01N 3/08* (2006.01)
*F01N 3/023* (2006.01)
*F01N 3/04* (2006.01)

(52) U.S. Cl.
CPC ..... *F01N 3/0828* (2013.01); *F01N 3/023* (2013.01); *F01N 3/04* (2013.01); *F01N 2260/024* (2013.01)

(58) Field of Classification Search
CPC ..... B01D 2257/80; B01D 2257/504; B01D 2259/40001; B01D 2259/40052; B01D 53/047; B01D 53/78; B01D 2258/06; B01D 2259/402; C01B 2203/043; C01B 2203/146; C01B 2203/147; Y02C 20/40
See application file for complete search history.

(56) References Cited

U.S. PATENT DOCUMENTS

| | | | |
|---|---|---|---|
| 9,404,685 | B2 | 8/2016 | Xuan et al. |
| 11,571,652 | B2 | 2/2023 | Shah et al. |
| 2022/0355244 | A1 | 11/2022 | Van Dam et al. |

FOREIGN PATENT DOCUMENTS

| | | | |
|---|---|---|---|
| CN | 102797544 | A | 11/2012 |
| CN | 101379279 | B | 11/2013 |
| CN | 109609223 | A | 4/2019 |
| EP | 2164600 | B1 | 10/2016 |
| EP | 3344368 | B1 | 9/2021 |

*Primary Examiner* — Anthony Ayala Delgado
(74) *Attorney, Agent, or Firm* — Harrity & Harrity, LLP

(57) ABSTRACT

An exhaust system includes an engine configured to produce an exhaust stream; a contactor column configured to cause the exhaust stream and a lean dehydration fluid to interact such that the lean dehydration fluid absorbs water molecules from the exhaust stream to produce a dry exhaust gas and a rich dehydration fluid including absorbed water molecules; a carbon capture system including carbon capture media configured to receive the dry exhaust gas and capture carbon dioxide from the dry exhaust gas to produce a depleted flue gas; and a fluid regeneration system configured to receive the rich dehydration fluid from the contactor column, convert the rich dehydration fluid into the lean dehydration fluid by removing the absorbed water molecules from the rich dehydration fluid, and provide the lean dehydration fluid to the contactor column for absorbing additional water molecules from the exhaust stream.

20 Claims, 5 Drawing Sheets

EXHAUST SYSTEM WITH A DEHYDRATION SUBSYSTEM UPSTREAM OF CARBON CAPTURE MEDIA

TECHNICAL FIELD

The present disclosure relates generally to carbon capture processes and methods for dehydrating an exhaust stream.

BACKGROUND

Engine exhaust emissions of carbon dioxide ($CO_2$) have a substantial role in contributing to greenhouse gases and to climate change. One method for separating and removing carbon dioxide from gas streams (e.g., exhaust streams) uses molecular sieves in conjunction with a temperature swing adsorption (TSA) technique. Due to high porosity and a clearly defined porous structure, molecular sieves allow for a selective adsorption of $CO_2$ molecules according to molecular size and shape. Typically, zeolites, which are crystalline aluminosilicates with homogeneous and clearly defined pore structures, are utilized as molecular sieves for $CO_2$ capture. Alternatively, solvent-based carbon capture may be used, in which a solvent (e.g., an amine solvent) is used to remove $CO_2$ from the gas stream.

A gas stream may become wet (e.g., saturated with water) as a result of a quenching process used to cool the gas stream. Additionally, or alternatively, the gas stream may become wet from humid air drawn into an exhaust system from the environment. Thus, one or more sources of moisture may be present that contribute to water being present in the gas stream prior to the gas stream reaching capture media of a carbon capture system.

The porous structure of molecular sieves makes molecular sieves an effective capture media for removing moisture and $CO_2$ from the gas stream. However, molecular sieves have a high affinity for water molecules, which can significantly impact a molecular sieve's ability to adsorb $CO_2$ from the gas stream. In a presence of water molecules in the gas stream, competition arises between $CO_2$ molecules and water ($H_2O$) molecules for adsorption on a zeolite surface of a molecular sieve. Consequently, the $H_2O$ molecules can displace the $CO_2$ molecules, and $CO_2$ adsorption by the molecular sieve may decrease. Over time, water content may gradually accumulate on the molecular sieve. As a result, available adsorption sites on the zeolite surface of adsorbents may be predominantly occupied with $H_2O$ molecules, which may affect an adsorption capacity of $CO_2$ by the molecular sieve. In other words, the molecular sieve's ability to adsorb $CO_2$ from the gas stream and overall carbon capture efficiency may decrease due to the molecular sieve's high affinity for water molecules and due to the presence of water in the gas stream received by the molecular sieve.

Thus, it may be necessary to reduce or eliminate water molecules from the gas stream before the gas stream reaches the carbon capture media of the carbon capture system in order to increase an amount of $CO_2$ captured in carbon capture systems. Reducing or eliminating an amount of water molecules in the gas stream before the gas stream reaches the carbon capture media may be used to improve a carbon capture efficiency of a carbon capture system, which may include a reduction in regeneration times related to the carbon capture media.

The exhaust system of the present disclosure solves one or more of the problems set forth above and/or other problems in the field.

SUMMARY

In some implementations, an exhaust system includes an exhaust source configured to produce a hot exhaust gas; a contactor column configured to receive a wet exhaust gas and a lean dehydration fluid, wherein the wet exhaust gas is derived from the hot exhaust gas, and wherein the contactor column is configured to cause the wet exhaust gas and the lean dehydration fluid to interact such that the lean dehydration fluid absorbs at least a first portion of the water molecules from the wet exhaust gas to produce a dry exhaust gas and a rich dehydration fluid comprising absorbed water molecules; a carbon capture system comprising carbon capture media configured to receive the dry exhaust gas and capture $CO_2$ from the dry exhaust gas to produce a $CO_2$-depleted gas; and a regeneration system configured to receive the rich dehydration fluid from the contactor column, convert the rich dehydration fluid into the lean dehydration fluid by removing the absorbed water molecules from the rich dehydration fluid, and provide the lean dehydration fluid to the contactor column for absorbing additional water molecules from the wet exhaust gas, wherein the regeneration system includes a dehydration reboiler, wherein the dehydration reboiler is configured to receive the rich dehydration fluid, remove a first portion of water from the rich dehydration fluid by converting the first portion of water into steam, and produce a first regenerated dehydration fluid with first reduced water content, and wherein the regeneration system is configured to produce the lean dehydration fluid from the first regenerated dehydration fluid.

In some implementations, a method of performing a carbon capture process includes producing a wet exhaust gas including water molecules; causing the wet exhaust gas to interact with a lean dehydration fluid in a contactor column such that the lean dehydration fluid absorbs at least a portion of the water molecules from the wet exhaust gas in order to produce a dry exhaust gas substantially free of the water molecules and a rich dehydration fluid comprising absorbed water molecules; capturing, by a carbon capture system, $CO_2$ from the dry exhaust gas to produce a $CO_2$-depleted gas; converting, by a regeneration system, the rich dehydration fluid into a recycled lean dehydration fluid by removing the absorbed water molecules from the rich dehydration fluid; and providing, by the regeneration system, the recycled lean dehydration fluid as the lean dehydration fluid to the contactor column for absorbing additional water molecules from the wet exhaust gas.

In some implementations, an exhaust system includes an engine configured to produce an exhaust stream; a contactor column configured to receive the exhaust stream and a lean dehydration fluid, wherein the contactor column is configured to cause the exhaust stream and the lean dehydration fluid to interact such that the lean dehydration fluid absorbs at least a portion of water molecules from the exhaust stream to produce a dry exhaust gas and a rich dehydration fluid comprising absorbed water molecules; a carbon capture system comprising carbon capture media configured to receive the dry exhaust gas and capture $CO_2$ from the dry exhaust gas to produce a depleted flue gas; and a fluid regeneration system configured to receive the rich dehydration fluid from the contactor column, convert the rich dehydration fluid into the lean dehydration fluid by removing the absorbed water molecules from the rich dehydration fluid, and provide the lean dehydration fluid to the contactor column for absorbing additional water molecules from the exhaust stream.

DETAILED DESCRIPTION

Figure 1:
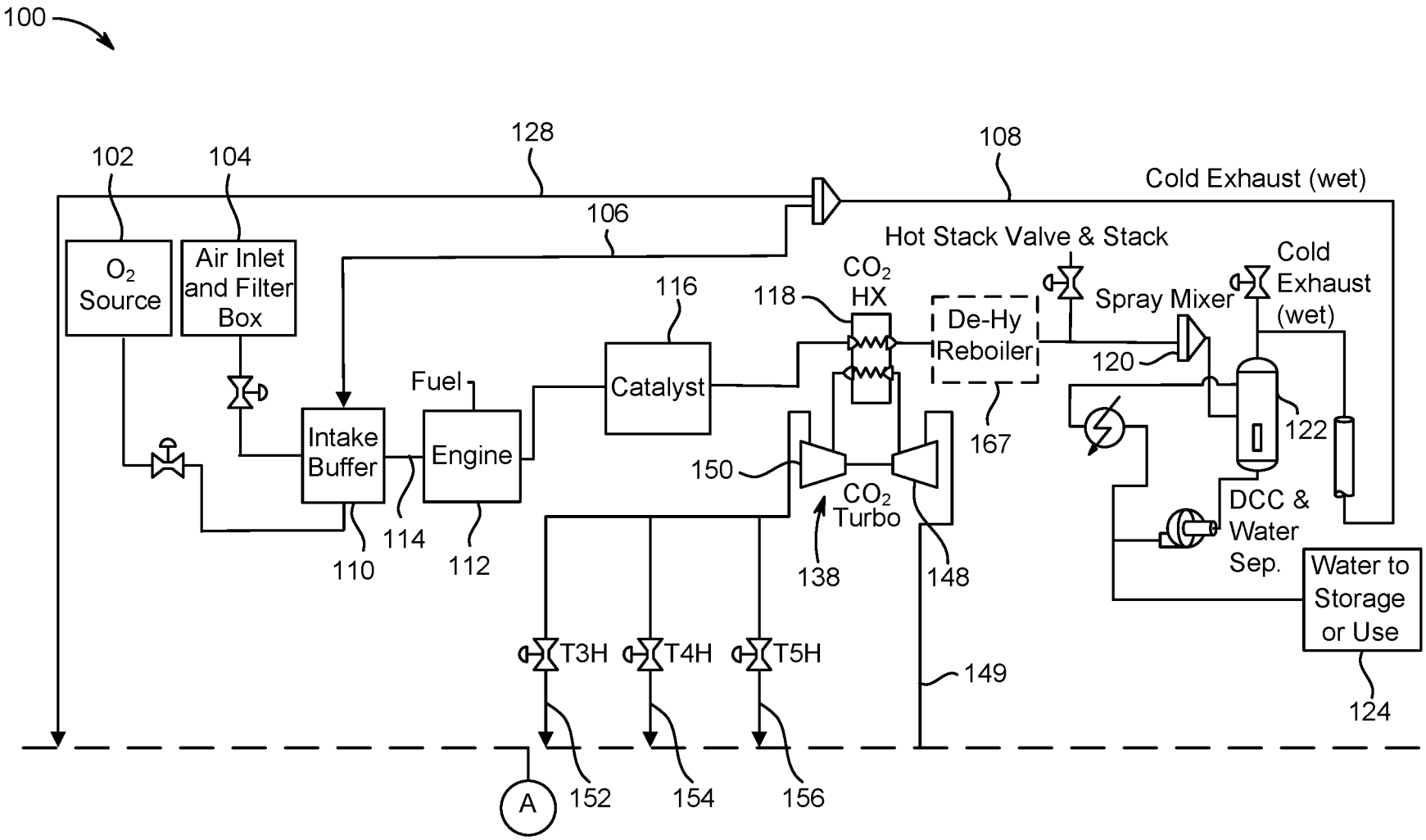
FIG. 1 illustrates an exhaust system according to one or more implementations.
Figure 1:
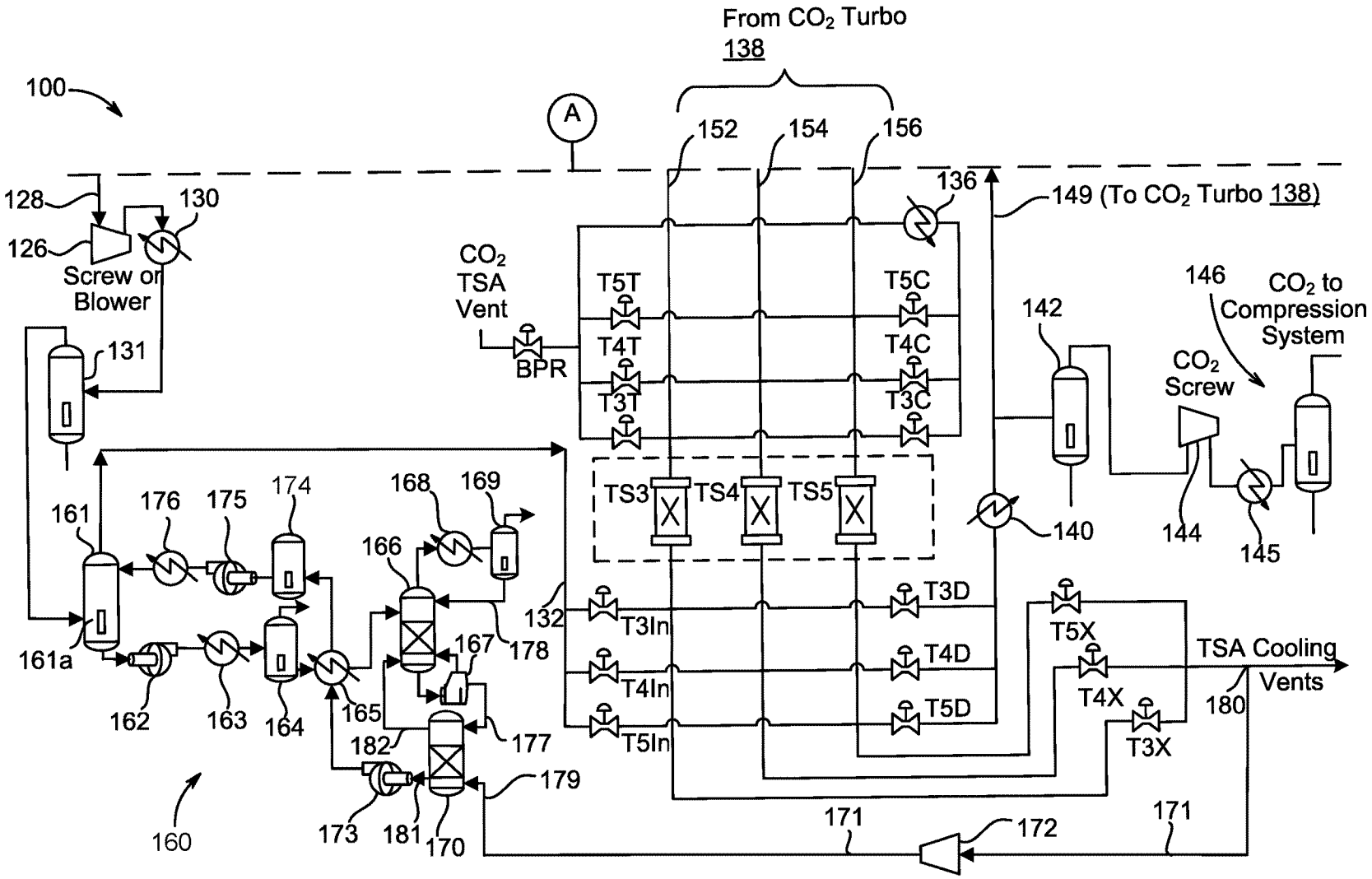

This disclosure relates to a carbon capture system which is applicable to any machine, system, or plant that uses a combustion engine, such as a piston engine or a turbine engine, as an exhaust source to produce an exhaust. For example, the carbon capture system may provide an enhanced carbon capture performance. In other words, the carbon capture system may increase an amount of $CO_2$ captured in a $CO_2$ capture process by reducing or eliminating an amount of water molecules in an exhaust stream that is provide to carbon capture media of the carbon capture system. In order to reduce or eliminate the amount of water molecules in the exhaust stream, a low-pressure dehydration (de-hy) unit or subsystem is arranged upstream from the carbon capture media (e.g., upstream from carbon capture vessels).

In some implementations, wet exhaust gas enters a scrubber of a contactor column and suspended water molecules are removed. In addition, further drying of the wet exhaust gas may be performed in the contactor column by forcing the wet exhaust to interact with a lean (e.g., dry) dehydration fluid, such as triethylene glycol (TEG), ethylene glycol (EG), or another glycol-based solvent. The lean dehydration fluid with high purity may be injected from a top of a contactor column to make contact with the wet exhaust gas. The lean dehydration fluid may absorb water from the wet exhaust gas, to produce a dry exhaust gas and a rich dehydration fluid. "Rich dehydration fluid" may refer to the lean dehydration fluid that has absorbed water from the wet exhaust gas. Thus, "rich dehydration fluid" refers to the lean dehydration fluid that is at least partially water saturated or wet.

In some implementations, "dry," "lean," "wet," and "rich" may be used herein for ease of description to describe one element or feature's relationship to another element(s) or feature(s) and are meant to be relative to each other and not restricted to any specific range of percent by volume. For example, "dry" may correspond to a gas or fluid that contains less water content than a wet gas or a wet fluid. Similarly, "lean" may correspond to a gas or fluid that contains less water content than a rich gas or a rich fluid. For example, in some implementations, a dry gas or a dry fluid may contain 50% less water than a corresponding wet gas or a corresponding wet fluid, respectively. In some implementations, a dry gas or a dry fluid may contain 75% less water than a corresponding wet gas or a corresponding wet fluid, respectively. In some implementations, a dry gas or a dry fluid may contain 90% less water than a corresponding wet gas or a corresponding wet fluid, respectively. In some implementations, a lean gas or a lean fluid may contain 50% less water than a corresponding rich gas or a corresponding rich fluid, respectively. In some implementations, a lean gas or a lean fluid may contain 75% less water than a corresponding rich gas or a corresponding rich fluid, respectively. In some implementations, a lean gas or a lean fluid may contain 90% less water than a corresponding rich gas or a corresponding rich fluid, respectively.

In some implementations, "dry" and "lean" may mean substantially free of water or water molecules. "Substantially free" may mean less than 1% by volume. Thus, "substantially free of water molecules" may refer to a fluid or a fluid mixture that is composed of less than 1% of water molecules by volume. In addition, "wet" or "rich" may mean saturated with or at least partially saturated with water or water molecules. For example, a fluid that is wet or rich may be composed of at least 1% of water molecules by volume.

In some implementations, a lean dehydration fluid may be made up of at least 99.9% dehydration fluid (e.g., at least 99.9% TEG). In some implementations, a dry gas may be composed of less than 0.5% of water molecules by volume, or less than 0.25% of water molecules by volume.

The dry exhaust gas, having been dried inside the contactor column, may be provided to the carbon capture media for carbon capture. The dry exhaust gas may be free or substantially free of water molecules. As a result, little to no water accumulates in the carbon capture media, which may improve carbon capture by the carbon capture media. In addition, less time may be needed to dry the carbon capture media, for example, during a regeneration process of the carbon capture media since the carbon capture media contains less water. Thus, a batch sequence for carbon capture may be improved.

Meanwhile, the rich dehydration fluid may undergo a fluid regeneration process to reduce a water content of the rich dehydration fluid before reusing the dehydration fluid for further gas dehydration. For example, the fluid regeneration process may be used to convert the rich dehydration fluid back into the lean dehydration fluid. In other words, the contactor column may receive a continuous stream of wet exhaust, and the fluid regeneration process may be used to remove water from the wet dehydration fluid to reproduce the lean dehydration fluid that can be used inside the contactor column for removing water from the continuous stream of wet exhaust. Thus, the rich dehydration fluid can be recycled back to the contactor column after being dehydrated by a fluid regeneration system. The fluid regeneration system may include a regeneration loop that may take the rich dehydration fluid from the contactor column, dehydrate the rich dehydration fluid to regenerate the lean dehydration fluid, and provide the regenerated lean dehydration fluid back to the contactor column for removing water content from the continuous stream of wet exhaust. As a result, the dehydration fluid may be reused after dehydrating the exhaust stream, to save in material costs and improve system efficiencies.

In addition, to reduce operating costs, waste heat from hot exhaust produced by an engine may be used by the fluid regeneration system for dehydrating the rich dehydration fluid. For example, the fluid regeneration system may include a dehydration reboiler that is used to remove water from the rich dehydration fluid (e.g., by evaporating the water from the rich dehydration fluid). The dehydration reboiler may be thermally coupled to the hot exhaust and use heat from the hot exhaust to evaporate the water from the rich dehydration fluid to regenerate the lean dehydration fluid. Thus, using waste heat from the hot exhaust may reduce energy costs associated with heating the dehydration reboiler.

FIG. 1 illustrates an exhaust system 100 according to one or more implementations. FIG. 1 is split into two portions that are conjoined along line A, with each of the two portions being on a different sheet. The exhaust system 100 includes a carbon capture system that includes components for a $CO_2$-TSA process (e.g., capture vessels TS3, TS4, and TS5 and other components interconnected with the capture vessels TS3, TS4, and TS5 for the purpose of capturing $CO_2$, collecting $CO_2$, or otherwise mitigating a release of $CO_2$ into the atmosphere). In some implementations, the exhaust system 100 may be referred to as a carbon capture system. In addition, the exhaust system 100 may include a semi-closed cycle (SCC). Components of the exhaust system 100 may be interconnected by a plurality of manifolds that may be configured to carry one or more fluids (e.g., liquids, gases, or gas-liquid mixtures).

The exhaust system 100 may include an $O_2$ source 102 (e.g., an $O_2$ plant) that provides $O_2$, an air inlet and filter box 104 that provides air, an SCC path 106 that is used to provide a portion of cooled exhaust from an exhaust return path 108, an intake buffer tank 110, and an engine 112. As is the case with any combustion engine, fuel is combusted, and that combustion requires an oxidizer, which is generally air. The engine 112 (e.g., a turbine engine or a piston engine) may draw in a working fluid 114 from the intake buffer tank 110. In some implementations, the engine 112 may be another type of exhaust source. The working fluid 114 used as an artificial atmosphere may be a mixture of air, oxygen, and cooled exhaust. A mixed concentration of oxygen in the intake buffer tank is a variable, but generally falls in the range of 12-22% $O_2$. The engine 112 combusts the fuel in the artificial atmosphere to produce a hot exhaust (e.g., a hot flue gas).

The hot exhaust may flow through a catalyst 116 to an exhaust heat exchanger 118 (e.g., $CO_2$ heat exchanger ($CO_2$ HX). The catalyst 116 may be used to convert methane that may be present in the hot exhaust into $CO_2$. The exhaust heat exchanger 118 may use a portion of the heat from the hot exhaust gas for regenerative purposes within a carbon capture process (e.g., for a regeneration stage of the exhaust system 100).

The hot exhaust gas may pass through the exhaust heat exchanger 118 to a cooling system. For example, the hot exhaust gas may be mixed with colder water by a spray mixer 120, which may quench the methane-depleted exhaust gas down to about 100° F. Additionally, or alternatively, a direct contact cooler (DCC) 122 (e.g., a gas-liquid separator) may be used to quench and cool the hot exhaust gas. As a result, some of the water from combustion products in the exhaust condenses, and the condensed water is removed in the DCC 122. The condensed water may accumulate in a water storage tank 124 unless the condensed water is otherwise used or disposed of. After water separation, the condensed water may be cooled and recycled back to the spray mixer 120 and/or the DCC 122 for cooling the hot exhaust gas. For example, the condensed water may be used as make-up water in a cooling tower, eliminating or reducing a problem of water disposal. Thus, the spray mixer 120 and/or the DCC 122 may operate as one or more components of the cooling system that is used to cool the hot exhaust gas into a cooled exhaust (e.g., cold exhaust).

A portion of the cooled exhaust (e.g., cold exhaust), now depleted of some water, may return to the intake buffer tank 110 via the SCC path 106, while a remaining portion of the cooled exhaust may be provided to a TSA screw/blower 126 (fan) via a TSA path 128. The SCC path 106 is part of an SCC exhaust loop that starts at the intake buffer tank 110, proceeds through the DCC 122 to the exhaust return path 108, and returns back through the SCC path to the intake buffer tank 110. The SCC may be used to increase $CO_2$ concentration for an adsorption bed (e.g., for capture vessels TS3, TS4, and TS5) via exhaust recirculation.

A flowrate at the TSA screw/blower 126, which may be a variable speed drive or may include other methods of flow regulation, indirectly sets a level of exhaust recirculation, since an engine flowrate is essentially fixed. Thus, $CO_2$ that is not removed by the exhaust system 100 (e.g., by the carbon pasture system) may be recirculated, and a balance of the artificial atmosphere at the engine 112 may be made up by air and/or oxygen.

Downstream of the TSA screw/blower 126 is a network of interconnected components that are responsible for performing the carbon capture via a $CO_2$-TSA process. In some implementations, a different type of carbon capture system may be used, such as a solvent-based carbon capture system (e.g., an amine carbon capture system). Immediately downstream of the TSA screw/blower 126 is a heat exchanger/chiller 130, which may further cool the cold exhaust to 35-50° F., which may cause more water present in the cold exhaust to condense, reducing a load on molecular sieves that follow. A tank 131 may be connected immediately downstream from the heat exchanger/chiller 130 to separate some or the remaining water from the cold exhaust.

While the DCC 122 and the heat exchanger/chiller 130 may be used to remove water from an exhaust stream, some water may remain in the exhaust stream downstream of the tank 131. In other words, the exhaust stream that exits the tank 131 may still be wet. The presence of water in the exhaust stream that flows into one or more $CO_2$ capture vessels may negatively impact an ability of carbon capture media within the one or more $CO_2$ capture vessels (e.g., capture vessels TS3, TS4, and TS5) to capture $CO_2$ from the exhaust stream.

Valves T3In, T4In, T5In, T3D, T4D, T5D, T3X, T4X, T5X, T3T, T4T, T5T, T3C, T4C, T5C, T3H, T4H, T5H, and BPR are used to control a flow of one or more fluids throughout the exhaust system 100. An open state and a closed state of each of the valves may be controlled by a controller (not illustrated) according to one or more process stages of the $CO_2$-TSA process. For example, three capture vessels TS3, TS4, or TS5 may be arranged in parallel, and the valves may be controlled such that a process stage at each one of the three capture vessels TS3, TS4, or TS5 (e.g., $CO_2$ capture vessels) is controlled based on a batch sequence of the $CO_2$-TSA process. For example, the valves may be controlled such that the capture vessel TS3 is in an adsorption stage (e.g., a capture stage), while the capture vessel TS4 is in a cooling stage and the capture vessel TS5 is in a regeneration stage. The valves may further be controlled such that the capture vessel TS4 is in an adsorption stage (e.g., a capture stage), while the capture vessel TS5 is in a cooling stage and the capture vessel TS3 is in a regeneration stage. The valves may further be controlled such that the capture vessel TS5 is in an adsorption stage (e.g., a capture stage), while the capture vessel TS3 is in a cooling stage and the capture vessel TS4 is in a regeneration stage. The batch sequence may then be repeated.

In some implementations, the capture vessels TS3, TS4, or TS5 may be referred to as "beds." Each capture vessel TS3, TS4, and TS5 may include media (e.g., capture media) that is configured to capture or adsorb $CO_2$. In some cases, the media may also adsorb water.

A first step in the $CO_2$-TSA process is a water dehydration process carried out by a dehydration system 160. The dehydration system 160 may be a dehydration subsystem integrated within the exhaust system 100. As described above, the cold exhaust gas may be a wet exhaust gas, and may still be sufficiently wet after exiting the tank 131 to negatively affect carbon capture within the capture vessels TS3, TS4, and TS5. The dehydration system 160, located between the cooling system (e.g., the DCC) and the capture vessels TS3, TS4, and TS5, may be configured to reduce water content (e.g., water vapor) in the wet exhaust gas by contacting the wet exhaust gas with a lean dehydration fluid, such as lean TEG, lean EG, or another lean glycol-based solvent. Thus, the dehydration system 160 may be located downstream from the DCC 122 to remove water introduced by the DCC 122 during cooling of the hot exhaust gas. The lean dehydration fluid may be configured to absorb water molecules from the wet exhaust gas, thereby removing water content from the exhaust stream. Thus, the dehydration system 160 is arranged upstream from the capture media of the carbon capture system in order to convert the wet exhaust gas into a dry exhaust gas that is to be processed by the carbon capture media for $CO_2$ capture. The capture media may be configured to receive the dry exhaust gas and capture $CO_2$ from the dry exhaust gas to produce a $CO_2$-depleted gas (e.g., a depleted flue gas).

At an adsorption inlet 132 of the capture vessels TS3, TS4, and TS5, the cold exhaust (e.g., the dry exhaust gas) has essentially zero water, and is typically composed of 5-20% $CO_2$, 0-10% $O_2$, and a balance inert mixture (e.g., nitrogen, with a little argon).

Assuming the capture vessel TS3 is at this point adsorbing $CO_2$, valve T3In will be open, with valves T4In and T5In closed. The exhaust gas, now depleted of $CO_2$ via the capture vessel TS3 and water via the dehydration system 160, flows out of the capture vessel TS3 via valve T3T, which is open, while valves T4T and T5T are closed. The exhaust gas flowing out of the capture vessel TS3 is a relatively warm dry gas having a temperature around 80-160° F., and is composed mostly of $N_2$ gas. The exhaust gas flowing out of the capture vessel TS3 flows out of the capture vessel TS3 and through the valve T3T and may be manifolded to several locations. For simplicity, this relatively warm dry gas that flows out of the capture vessel performing $CO_2$ adsorption (e.g., capture vessel TS3) may be referred to as a dry $N_2$ gas, a $CO_2$-depleted gas, or a depleted flue gas.

If all downstream valves are closed, or if a backpressure for some reason is too high, any excess dry $N_2$ gas will be discharged to atmosphere via a $CO_2$ TSA vent, controlled by a back pressure regulator of the valve BPR. Generally, the backpressure is lower than a setpoint of the back pressure regulator and the valve BPR remains closed.

After chilling and condensation, there is in most cases an order of magnitude more $CO_2$ in the exhaust than water in the exhaust, and the capacity for $CO_2$ per unit weight of mole sieve is lower than that of water. As a result, cycle times for $CO_2$ adsorption in the capture vessels TS3, TS4, and TS5 are measured in minutes, not hours. Assuming the capture vessel TS3 is adsorbing $CO_2$ (e.g., valves T3In and T3T are open), a portion of the dry $N_2$ gas that exits the capture vessel TS3 via valve T3T, optionally further cooled via a heat exchanger/chiller 136, can pass through valve T4C to provide cooling to the capture vessel TS4, and can exit via valve T4X. It is noted that the volume of gas required for cooling may not be met fully by the flow rate coming from the capture vessel TS3, and methods to augment the flow via recirculation or mitigate the amount of flow needed are described below.

After the $CO_2$ adsorption cycle is complete (e.g., in capture vessel TS3), the captured $CO_2$ must be released during the regeneration stage. In a $CO_2$-TSA process, releasing captured $CO_2$ is done mostly via heating. For example, when a mole sieve is cold and a partial pressure of a desired species is high, the mole sieve will adsorb the desired species. The mole sieve will release the desired species when a temperature is increased, and/or the partial pressure is lowered. Hence, the terms pressure swing, thermal swing, vacuum swing, or combinations of the swing processes are used to describe the capture and release of the desired species by the mole sieve.

In the present disclosure, that heating is provided by a hot gas mixture, which is mostly hot $CO_2$ in this example delivered via valve T3H to the capture vessel TS3. The hot $CO_2$ is generally at 600-800° F. The hot $CO_2$ gas flows downward from a $CO_2$-turbocharger 138, through valve T3H, and through the media in the capture vessel TS3, which gradually heats the media, and drives off more $CO_2$. Warm $CO_2$ exits the capture vessel TS3 and flows via valve T3D to a cooler 140 (e.g., a heat exchanger), and a portion of the $CO_2$ gas splits off, flowing through a separator 142 (in theory unneeded, this being dry gas, it is really there to add volume to improve control), to a $CO_2$ screw compressor 144, to a chiller 145 (e.g., a heat exchanger), a $CO_2$ storage tank 146, and downstream to the rest of the $CO_2$ compression or use systems. The flowrate at the $CO_2$ screw compressor 144, also generally variable speed, indirectly sets a pressure in the capture vessel TS3 during a desorption process of the regeneration stage.

A desorption flowrate required is much higher than a raw exhaust flowrate on both a mass and volume basis. In addition, given the higher temperature, a pressure drop through the capture vessel would also be higher, up to 10 psi, vs. 1-2 psi for adsorption, resulting in high electrical loads. In the present disclosure, the $CO_2$ gas produced during the desorption process is recirculated to support these higher flowrates, and more importantly, a powering for a recirculation of the $CO_2$ gas is performed by the $CO_2$-turbocharger 138.

Heat used to power the $CO_2$-turbocharger 138, and to heat a capture vessel TS3, TS4, or TS5 during the regeneration stage, may come from the exhaust of the engine 112. After passing through valve T3D and the cooler 140, a portion of the $CO_2$ gas released from the relevant capture vessel TS3, TS4, or TS5 (e.g., capture vessel TS3 in this example) enters a turbocharger compressor 148 of the $CO_2$-turbocharger 138 via manifold 149, boosted in pressure (e.g., to 15-25 psi), raising the temperature of the $CO_2$ gas to 300° F. or more. In other words, the manifold 149 connects capture vessel TS3, TS4, and TS5 to the turbocharger compressor 148 of the $CO_2$-turbocharger 138 to transport a $CO_2$ stream of $CO_2$ gas generated by a capture vessel set in the regeneration stage to the turbocharger compressor 148.

The heated $CO_2$ gas from the turbocharger compressor 148 then enters the exhaust heat exchanger 118 (e.g., $CO_2$ HX), and is heated to near raw exhaust temperature, typically 800-900° F. or higher, by a heat exchange process that uses the exhaust from the engine 112 (e.g., the heat from the hot exhaust gas provided by the catalyst 116) for further heating the heated $CO_2$ gas to produce hot $CO_2$ gas. This hot $CO_2$ gas is then expanded through an expander 150 (e.g., a decompressor) of the $CO_2$-turbocharger 138 (which causes the temperature of the hot $CO_2$ to drop due to less pressure). However, due to the super-heating process performed by the turbocharger compressor 148 and the exhaust heat exchanger 118, the $CO_2$ gas exiting the expander 150 still has a temperature equal to or greater than 600° F. that is sufficient for the regeneration process, and still at a pressure high enough to support a flow through the capture vessel TS3, TS4, or TS5 that is performing the regeneration (e.g., capture vessel TS3 in this example). For example, a pressure increase on a compressor side of the $CO_2$-turbocharger 138 significantly exceeds a pressure decrease on an expander side of the $CO_2$-turbocharger 138, such that a pressure of the $CO_2$ gas exiting the expander 150 toward the capture vessel TS3, TS4, or TS5 is high enough to support the flow of the $CO_2$ gas through the capture vessel TS3, TS4, or TS5 that is performing the regeneration. The expander 150 may be respectively coupled to the capture vessels TS3, TS4, TS5 via manifolds 152, 154, and 156 to provide a heated $CO_2$ gas to a capture vessel that is set in the regeneration stage. Thus, the heat from the hot exhaust may be used, via the exhaust heat exchanger 118 and the $CO_2$-turbocharger 138, to improve the regeneration of the capture media by reducing an amount of time for regeneration and/or increasing a percentage of carbon captured by the capture media due to increased regeneration. At an end of the regeneration process, virtually no $CO_2$, and almost no water, remains in the capture vessel TS3, TS4, or TS5 that is performing the regeneration (e.g., the capture vessel TS3).

As a result of the regeneration process, the media (e.g., the mole sieve) of the capture vessel TS3, TS4, or TS5 is hot, typically with an average temperature of about 500° F., and must be cooled to prepare the capture vessel for a next $CO_2$ adsorption cycle. A cooling process for the capture vessel TS3 is accomplished by opening valves T3C and T3X, while closing valves T3In, T3T, T3H, and T3D. In other words, the dry (warm) $N_2$ gas that exits the capture vessel set in the adsorbing stage (e.g., capture vessel TS5 for cooling of capture vessel TS3) is directed into the capture vessel TS3 for cooling the media of the capture vessel TS3.

The cooling process need not return the media temperature fully to ambient temperature. Any temperature under 100° C. (212° F.) will provide some capacity for initial adsorption of $CO_2$, with temperatures near or below 50° C. (122° F.) being preferred. The cooling process may continue in parallel with the adsorption process to some extent since a raw exhaust stream from cooler P2T (e.g., a heat exchanger) is provided at nominally 10° C. (50° F.).

The dehydration system 160 may include a contactor column 161, a pump 162, a heater 163, a flash drum 164, a heat exchanger 165, a first regenerator column 166, a dehydration reboiler 167, partial condenser 168, a separator 169 (e.g., a liquid-gas separator or phase separator), a second regenerator column 170, a stripper gas path 171 configured to carry a stripper gas, a fan 172, a pump 173, an accumulator 174, a pump 175, and a cooler 176. The contactor column 161 may be configured to dehydrate the wet exhaust gas to produce the dry exhaust gas that is provided to the adsorption inlet 132 of the capture vessels TS3, TS4, and TS5. The remaining components of the dehydration system 160 may form a fluid regeneration system that may be configured to receive a rich dehydration fluid from the contactor column 161, convert the rich dehydration fluid into the lean dehydration fluid (e.g., a regenerated lean dehydration fluid) by removing absorbed water molecules from the rich dehydration fluid, and provide the lean dehydration fluid to the contactor column 161 for absorbing additional water molecules from the wet exhaust gas. Thus, dehydration fluid may be recycled in a regeneration loop of the fluid regeneration system.

The wet exhaust gas may enter a bottom of the contactor column 161, while the lean dehydration fluid may be introduced at a top of the contactor column 161. The contactor column 161 may include a scrubber 161*a* at the bottom to remove water suspended in the wet exhaust gas. Any water removed by the scrubber 161*a* may be directed to a bottom outlet of the contactor column 161. However, the wet exhaust gas remains wet and requires further drying. The wet exhaust gas may be directed through connecting channels to tower internal components of the contactor column 161 for additional drying.

Inside the contactor column 161, after passing through the scrubber 161*a*, the wet exhaust gas flows upwards through the tower internal components. Meanwhile, the lean dehydration fluid drops down from the top and makes contact with the wet exhaust gas. The tower internal components may force the wet exhaust gas to interact with the descending lean dehydration fluid. As the wet exhaust gas moves upwards through the tower internal components, the wet exhaust gas becomes progressively drier, giving up water to the lean dehydration fluid. In particular, water vapor in the wet exhaust gas may be absorbed by the lean dehydration fluid, saturating or at least partially saturating the lean dehydration fluid to produce the rich dehydration fluid (e.g., converting the lean dehydration fluid into the rich dehydration fluid due to the absorption of water). Having all or substantially all water extracted from the wet exhaust gas by the lean dehydration fluid, the contactor column 161 produces the dry exhaust gas. The dry exhaust gas may exit from the contactor column 161 at a top outlet of the contactor column 161, while the rich dehydration fluid may exit from the contactor column 161 at the bottom outlet of the contactor column 161. Afterwards, the rich dehydration fluid may undergo regeneration to reduce a water content of the rich dehydration fluid before reusing the dehydration fluid for gas dehydration. For example, the rich dehydration fluid may be processed by the fluid regeneration system and converted back into the lean dehydration fluid for reuse. The contactor column 161 may be configured to operate under low pressure. For example, the contactor column 161 may be configured to, while producing the dry exhaust gas and the rich dehydration fluid, operate at a pressure between 0.5 and 2.0 bar absolute. Operating the dehydration system 160 under a lower partial pressure, between 0.5 and 2.0 bar absolute, may allow more water to leave a liquid phase to a gas phase for removal and expulsion.

In summary, the contactor column 161 may be configured to receive the wet exhaust gas and the lean dehydration fluid configured to absorb at least a first portion of the water molecules from the wet exhaust gas. The contactor column 161 may be configured to cause the wet exhaust gas and the lean dehydration fluid to interact such that the lean dehydration fluid absorbs at least the first portion of the water molecules from the wet exhaust gas to produce the dry exhaust gas and the rich dehydration fluid comprising absorbed water molecules. In some implementations, the contactor column 161 may include the scrubber 161*a*, which may remove a second portion of the water molecules from the wet exhaust gas to produce the dry exhaust gas. Thus, the rich dehydration fluid that exits the contactor column 161 at the bottom outlet may include the first portion of the water molecules removed by the lean dehydration fluid, and may include the second portion of the water molecules removed by the scrubber 161*a*.

The pump 162 may pump the rich dehydration fluid from the bottom outlet of the contactor column 161 to the heater 163, which may be used to preheat the rich dehydration fluid for the flash drum 164. The flash drum 164 may be configured to flash a carryover gas that is trapped in the rich dehydration fluid. The carryover gas may be exhaust gas from the wet exhaust gas that becomes trapped in the dehydration fluid during contact in the contactor column 161. In other words, the carryover gas may be exhaust gas included in the rich dehydration fluid prior to being flashed by the flash drum 164. Flash evaporation in the flash drum 164 may be used to separate the exhaust gas from the rich dehydration fluid. Thus, the flash drum 164 may operate as a two-phase separator to flash the exhaust gas out of a liquid solution of the rich dehydration fluid. The carryover gas, having been separated from the rich dehydration fluid, may be purged from a top outlet of the flash drum 164. Meanwhile, the rich dehydration fluid, with the carryover gas removed, may exit the flash drum 164 from a bottom outlet coupled to the heat exchanger 165. Thus, the flash drum 164 may receive the rich dehydration fluid from the contactor column 161, flash a carryover gas out of the rich dehydration fluid to separate the carryover gas from the rich dehydration fluid, and provide the rich dehydration fluid to components further downstream in the fluid regeneration system. For example, the rich dehydration fluid may ultimately be provided to the dehydration reboiler 167 after being processed and passed through the first regenerator column 166. Additionally, the flash drum 164 may expel the carryover gas from the fluid regeneration system via the top outlet of the flash drum 164.

The heat exchanger 165, arranged between the flash drum 164 and the dehydration reboiler 167, may heat the rich dehydration fluid prior to the rich dehydration fluid being provided to the first regenerator column 166 and the dehydration reboiler 167. For example, the heat exchanger 165 may preheat the rich dehydration fluid for the first regenerator column 166 to assist in evaporating water content in the rich dehydration fluid in the first regenerator column 166. In some implementations, the heat exchanger 165 may be a glycol-glycol heat exchanger. The heat exchanger 165 may increase heat conservation by contacting hot and cold glycol streams during the fluid regeneration process. The heat exchanger 165 may provide the rich dehydration fluid to the first regenerator column 166.

The first regenerator column 166 may be a packed column that facilitates downward flow of the rich dehydration fluid to the dehydration reboiler 167. The rich dehydration fluid may descend through the packed column of the first regenerator column 166, and exit the bottom of the first regenerator column 166 to the dehydration reboiler 167 where the rich dehydration fluid meets hot (e.g., boiling) dehydration fluid. Water in the rich dehydration fluid boils and becomes steam, which exits at a top of the dehydration reboiler 167 and rises through the packed column of the first regenerator column 166. Meanwhile, dehydration fluid drops back into the dehydration reboiler 167 and leaves the dehydration reboiler 167 as a partially regenerated dehydration fluid toward the second regenerator column 170. Thus, the dehydration reboiler 167 may receive the rich dehydration fluid from the first regenerator column 166, remove a first portion of water from the rich dehydration fluid by converting the first portion of water into steam, and produce a first regenerated dehydration fluid 177 with first reduced water content. The steam may flow out of a top outlet of the first regenerator column 166. The regeneration system may be configured to produce the lean dehydration fluid from the first regenerated dehydration fluid 177 via further dehydration and processing.

In some implementations, the dehydration reboiler 167 may be thermally coupled to the hot exhaust and may use heat from the hot exhaust to evaporate the water from the rich dehydration fluid to regenerate the lean dehydration fluid. For example, the dehydration reboiler 167 may be thermally coupled to the hot exhaust gas upstream from the cooling system (e.g., upstream from the spray mixer 120 and/or the DCC 122). The dehydration reboiler 167 may use heat from the hot exhaust gas to boil the rich dehydration fluid in order to produce the steam and the first regenerated dehydration fluid 177. Thus, using waste heat from the hot exhaust may reduce energy costs associated with heating the dehydration reboiler 167.

A top product of the first regenerator column 166 may include water vapor with a small amount of dehydration fluid that may have evaporated in the dehydration reboiler 167. In other words, the steam that exits the top outlet of the first regenerator column 166 may be a mixture of water vapor and the small amount of dehydration fluid. The first regenerator column 166 may to receive the rich dehydration fluid and provide the rich dehydration fluid to the dehydration reboiler 167, may receive the steam from the dehydration reboiler 167, and may provide the steam to the partial condenser 168. The small amount of dehydration fluid in the steam may be condensed by the partial condenser 168 and recycled back to the first regenerator column 166. The partial condenser 168 may condense the small amount of dehydration fluid without condensing the water vapor in the steam. Thus, the partial condenser 168 may be used to convert the small amount of dehydration fluid into a liquid, while keeping the water vapor in a gaseous phase. The separator 169 may separate the liquid (condensed) dehydration fluid from the water vapor by collecting the liquid (condensed) dehydration fluid at a bottom of the separator 169, while allowing the water vapor to exit a top of the separator 169. The liquid (condensed) dehydration fluid may flow back to the first regenerator column 166 and drop down the first regenerator column 166 to the dehydration reboiler 167.

Thus, the steam that exits from the top of the first regenerator column 166 may include an evaporated portion of dehydration fluid and a first water vapor. The partial condenser 168 may condense the evaporated portion of dehydration fluid in the steam into a recycled dehydration liquid 178. The separator 169 may separate the recycled dehydration liquid and the first water vapor, expel the first water vapor from the regeneration system, and provide the recycled dehydration liquid 178 to the dehydration reboiler 167 via the first regenerator column 166. The recycled dehydration liquid 178 may combine with the hot dehydration liquid in the dehydration reboiler 167 and may become part of the first regenerated dehydration fluid 177. Thus, the partial condenser 168 and the separator 169 may be used to prevent some of the dehydration fluid from escaping the fluid regeneration system or the dehydration system 160 as a whole. In other words, the partial condenser 168 and the separator 169 may reduce or eliminate loss of the dehydration fluid in the dehydration system 160, which may reduce operation and materials costs associated with injecting more dehydration fluid into the dehydration system 160.

The second regenerator column 170 may receive the first regenerated dehydration fluid 177 from the dehydration reboiler 167 and a stripper gas 179 from the carbon capture system (e.g., from one of the capture vessels TS3, TS4, or TS5). The stripper gas 179 may be provided by the stripper gas path 171 that is coupled to TSA cooling vents at vent outlet 180. The fan 172 may be configured to draw the stripper gas 179 from the TSA cooling vents and provide the stripper gas 179 to the second regenerator column 170 for a stripping process. The stripper gas 179 may be a gas associated with TSA cooling bed discharge. For example, in some implementations, the dry $N_2$ gas (e.g., the $CO_2$-depleted gas or the depleted flue gas) used in the cooling stages of the $CO_2$-TSA processes may be used as the stripper gas 179. For example, the dry $N_2$ gas passed through one of the capture vessels TS3, TS4, TS5 that is set in the cooling stage may be directed to the second regenerator column 170 via the stripper gas path 171 as the stripper gas 179. The dry $N_2$ gas has essentially zero water and zero $CO_2$.

The second regenerator column 170 may cause the first regenerated dehydration fluid 177 and the stripper gas 179 to interact such that the stripper gas 179 removes a second portion of water from the first regenerated dehydration fluid 177 to produce a second regenerated dehydration fluid 181 with second reduced water content that is less than the first reduced water content. In other words, the second regenerated dehydration fluid 181 has less water content than the first regenerated dehydration fluid 177. For example, the stripper gas 179 may remove the second portion of water from the first regenerated dehydration fluid 177 as a second water vapor. Thus, the stripper gas 179 is sufficiently dry and/or hot to extract water from the first regenerated dehydration fluid 177 in the form of the second water vapor and carry the second water vapor out of the second regenerator column 170 as a discharge gas 182. The discharge gas 182 may be a combination of the stripper gas 179 and the second water vapor.

The second regenerator column 170 may provide the discharge gas 182 (e.g., the stripper gas 179 and the second water vapor) to the first regenerator column 166. The discharge gas 182 may travel up the first regenerator column 166 to the top outlet of the first regenerator column 166. As the discharge gas 182 flows through the first regenerator column 166, the stripper gas may remove some water content from the rich dehydration fluid and the discharge gas 182 may exit the top outlet of the first regenerator column 166 with the steam. Thus, the first regenerator column 166 may provide the discharge gas 182 (e.g., the stripper gas 179 and the second water vapor) along with the steam (e.g., the evaporated portion of dehydration fluid and the first water vapor) to the separator 169 via the partial condenser 168. The separator 169 may expel the discharge gas 182 from the regeneration system.

The regeneration system may produce the lean dehydration fluid from the second regenerated dehydration fluid 181. In some implementations, the second regenerated dehydration fluid 181 is provided as the lean dehydration fluid. The pump 173 may pump the second regenerated dehydration fluid 181 to the heat exchanger 165. The heat exchanger 165 may cool the second regenerated dehydration fluid 181 (e.g., the lean dehydration fluid) produced by the regeneration system prior to the regeneration system providing the second regenerated dehydration fluid 181 to the contactor column 161. In some implementations, the heat exchanger 165 may be configured to cool the second regenerated dehydration fluid 181 to produce the lean dehydration fluid.

The heat exchanger 165 may provide the second regenerated dehydration fluid 181 (e.g., the lean dehydration fluid) to the accumulator 174, which collects the second regenerated dehydration fluid 181. The pump 175 may pump the second regenerated dehydration fluid 181 from the accumulator 174 to the cooler 176 to further cool the second regenerated dehydration fluid 181. The cooler 176 may provide the lean dehydration fluid (e.g., the regenerated lean dehydration fluid) to the contactor column 161 to be used for absorbing additional water molecules from the wet exhaust gas in a subsequent or continuous dehydration process. Accordingly, the fluid regeneration system of the dehydration system 160 may convert the rich dehydration fluid into a recycled lean dehydration fluid (e.g., the regenerated lean dehydration fluid) by removing the absorbed water molecules from the rich dehydration fluid, and provide the recycled lean dehydration fluid as the lean dehydration fluid to the contactor column 161 for absorbing additional water molecules from the wet exhaust gas.

Figure 2:
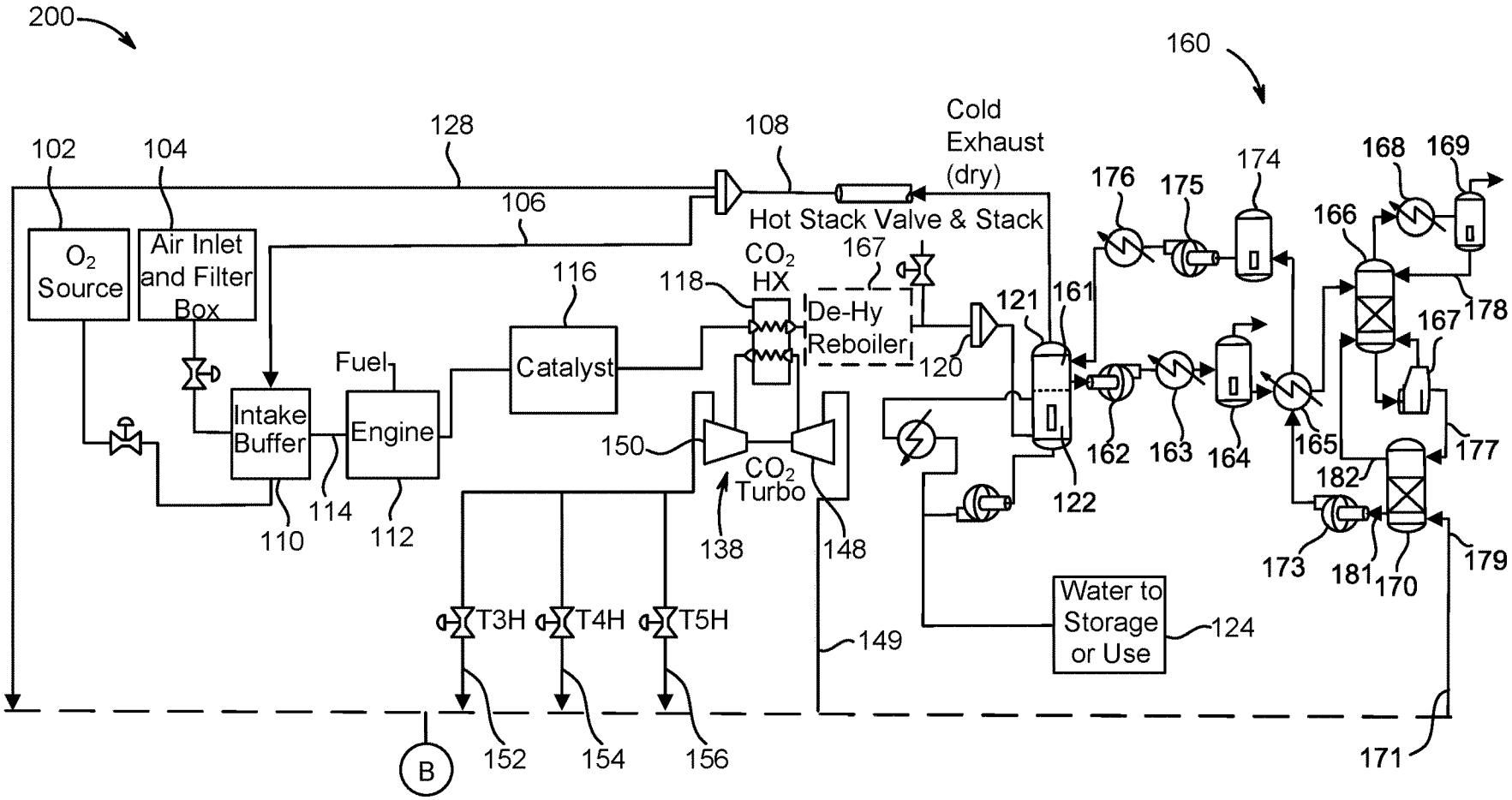
FIG. 2 illustrates an exhaust system according to one or more implementations.
Figure 2:
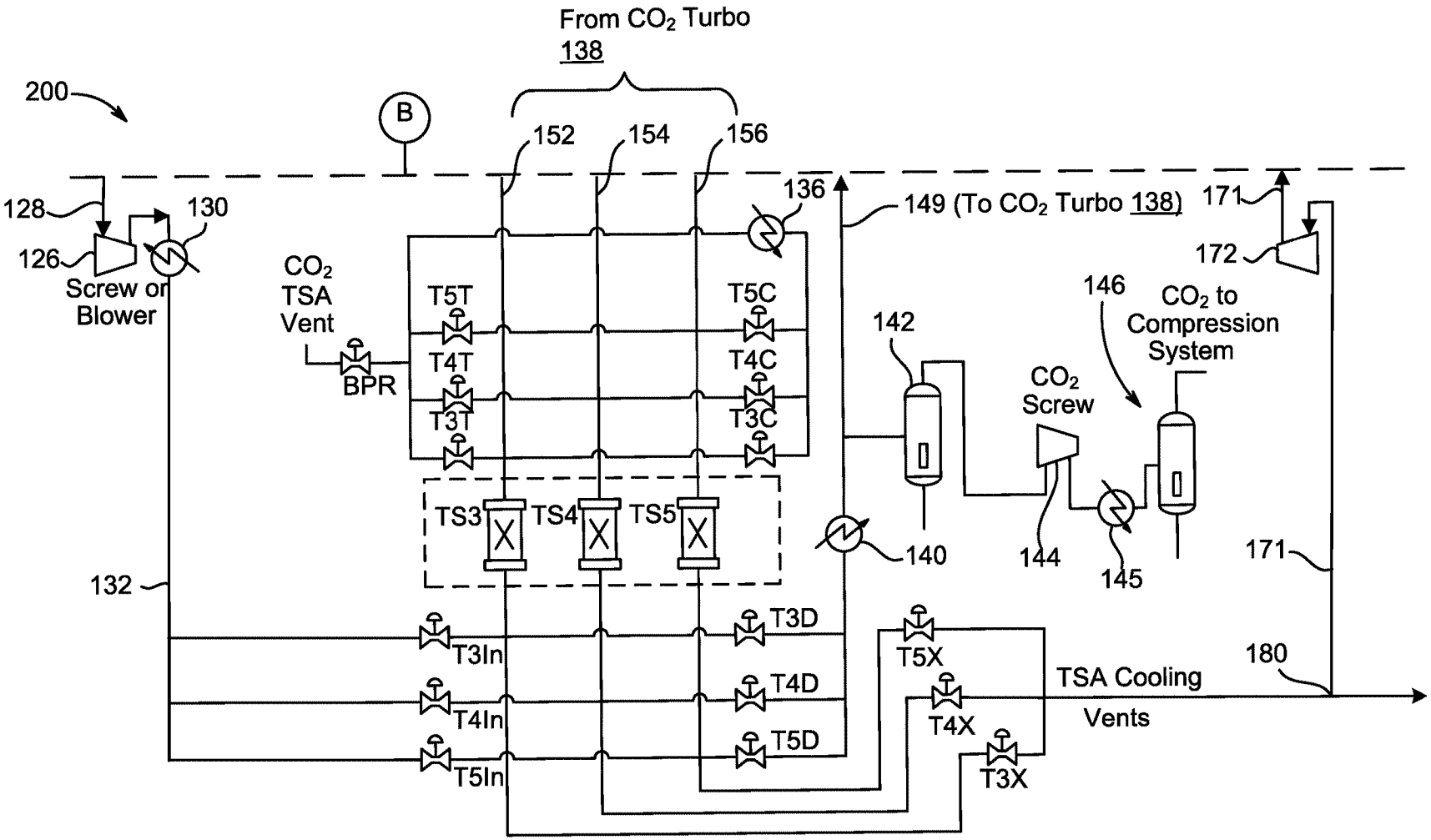

FIG. 2 illustrates an exhaust system 200 according to one or more implementations. FIG. 2 is split into two portions that are conjoined along line B, with each of the two portions being on a different sheet. The exhaust system 200 includes components for a $CO_2$-TSA process with a semi-closed cycle. The components may be interconnected by a plurality of manifolds that may be configured to carry one or more fluids (e.g., liquids, gases, or gas-liquid mixtures).

The exhaust system 200 may be similar to the exhaust system 100 described in connection with FIG. 1, with the exception that the dehydration system 160 is arranged upstream from the TSA screw/blower 126, and the DCC 122 and the contactor column 161 are arranged in a same vessel 121. While the DCC 122 and the contactor column 161 are arranged in the vessel 121, the contactor column 161 is still arranged downstream from the DCC 122 in the exhaust flow path. Thus, the exhaust gas may exit the vessel 121 as a dry, cooled (e.g., cold) exhaust gas. In other words, the hot exhaust gas produced by the engine 112 may enter the DCC 122 of vessel 121, leave the DCC 122 as wet, cooled exhaust gas, enter the contactor column 161 of the vessel 121 as the wet, cooled exhaust gas, and leave the contactor column 161 and the vessel 121 as the dry, cooled exhaust gas. The contactor column 161 may provide the dry, cooled exhaust gas to the exhaust return path 108, which may provide the dry, cooled exhaust gas to the capture media of the carbon capture system (e.g., to the adsorption inlet 132 of the capture vessels TS3, TS4, and TS5).

Figure 3:
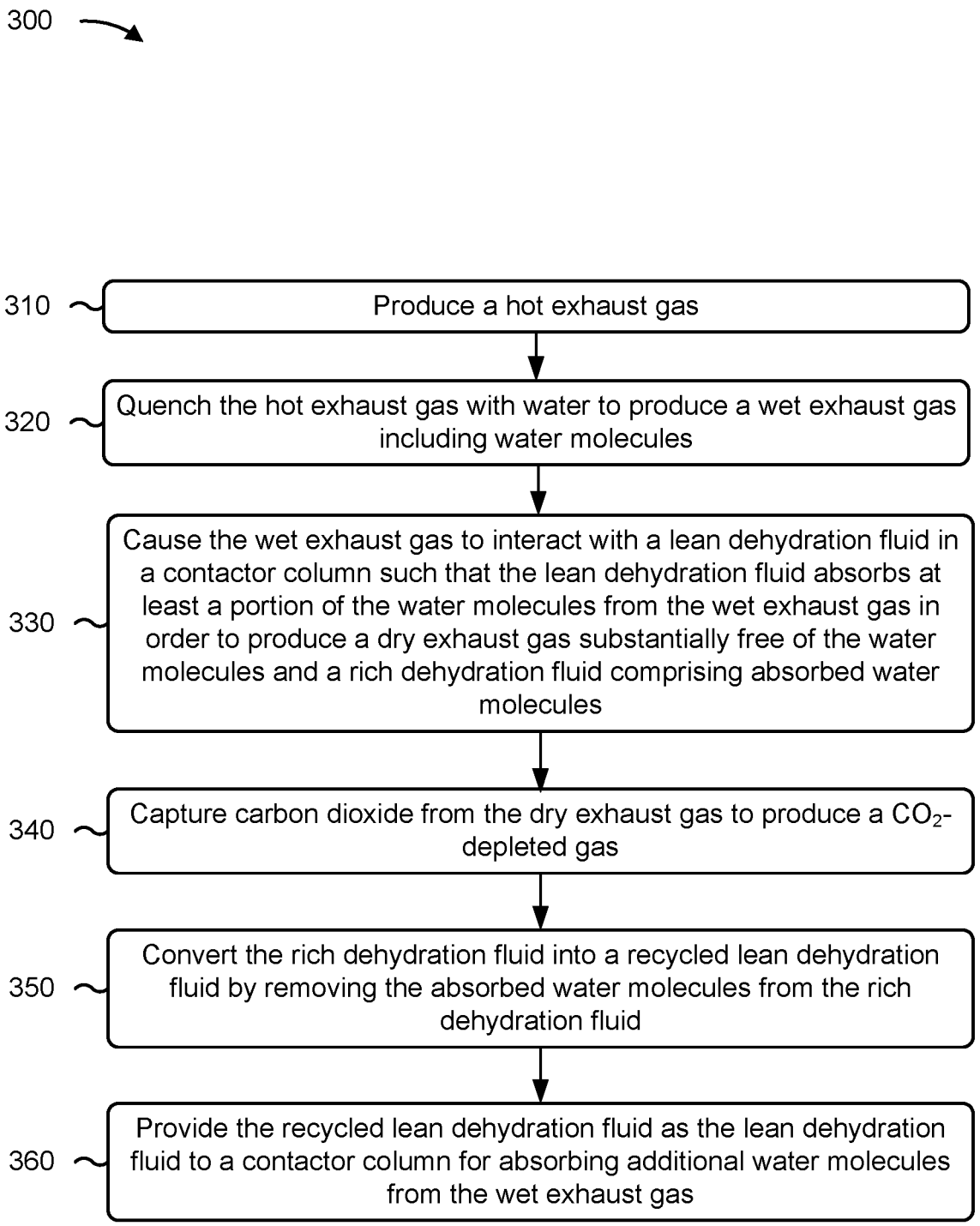
FIG. 3 is a flowchart of an example process associated with a carbon capture system.

FIG. 3 is a flowchart of an example process 300 associated with exhaust system with a dehydration subsystem upstream of carbon capture media. In some implementations, one or more process blocks of FIG. 3 are performed by an exhaust system (e.g., exhaust system 100 or exhaust system 200). Additionally, or alternatively, one or more process blocks of FIG. 3 may be performed by one or more components of a dehydration system (e.g., dehydration system 160), such as the contactor column 161 and/or the fluid regeneration system. One or more controllers and/or processors may be used to control a method of exhaust dehydration, dehydration fluid regeneration and recycling, and/or carbon capture.

As shown in FIG. 3, process 300 may include producing a hot exhaust gas (block 310). For example, the engine 112 may be an exhaust source that may produce an exhaust gas containing methane, as described above.

As further shown in FIG. 3, process 300 may include quenching the hot exhaust gas with water to produce a wet exhaust gas including water molecules (block 320). For example, the DCC 122 may quench the hot exhaust gas with water to produce a wet exhaust gas including water molecules, as described above. Quenching may be optional. For example, the exhaust gas may become wet (e.g., saturated with water) as a result of a quenching process used to cool the exhaust gas. Additionally, or alternatively, the exhaust gas may become wet from humid air drawn into an exhaust system from the environment, or from another source of water molecules. Thus, one or more sources of moisture may be present that contribute to water being present in the exhaust gas prior to the gas stream reaching capture media of a carbon capture system.

As further shown in FIG. 3, process 300 may include causing the wet exhaust gas to interact with a lean dehydration fluid in a contactor column such that the lean dehydration fluid absorbs at least a portion of the water molecules from the wet exhaust gas in order to produce a dry exhaust gas substantially free of the water molecules and a rich dehydration fluid comprising absorbed water molecules (block 330). For example, the contactor column 161 may cause the wet exhaust gas to interact with the lean dehydration fluid in a contactor column such that the lean dehydration fluid absorbs at least a portion of the water molecules from the wet exhaust gas in order to produce the dry exhaust gas substantially free of the water molecules and to produce the rich dehydration fluid comprising absorbed water molecules, as described above.

As further shown in FIG. 3, process 300 may include capturing $CO_2$ from the dry exhaust gas to produce a $CO_2$-depleted gas (block 340). For example, the capture vessels TS3, TS4, or TS5 may be used according to a $CO_2$-TSA process to capture $CO_2$ from the dry exhaust gas to produce the $CO_2$-depleted gas, as described above.

As further shown in FIG. 3, process 300 may include converting the rich dehydration fluid into a recycled lean dehydration fluid by removing the absorbed water molecules from the rich dehydration fluid (block 350). For example, the fluid regeneration system may convert the rich dehydration fluid into the recycled lean dehydration fluid by removing the absorbed water molecules from the rich dehydration fluid, as described above.

As further shown in FIG. 3, process 300 may include providing the recycled lean dehydration fluid as the lean dehydration fluid to the contactor column for absorbing additional water molecules from the wet exhaust gas (block 360). For example, the fluid regeneration system may provide the recycled lean dehydration fluid as the lean dehydration fluid to the contactor column 161 for absorbing additional water molecules from the wet exhaust gas, as described above.

Process 300 may include additional implementations, such as any single implementation or any combination of implementations described below and/or in connection with one or more other processes described elsewhere herein.

Although FIG. 3 shows example blocks of process 300, in some implementations, process 300 includes additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The described implementations significantly reduce an amount of water present in an exhaust stream prior to the exhaust stream being provided to a carbon capture media of a carbon capture system. By doing so, the carbon capture media is capable of capturing a higher amount of $CO_2$ from the exhaust stream, and may result in lower $CO_2$ emissions into the atmosphere. The described systems include components and processes designed to achieve optimal performance in terms of $CO_2$ capture efficiency, lower costs of carbon capture, and use of waste heats to reduce the operation costs.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

Temperature relative terms, such as "warm," "hot," "hotter," "cold," "colder," "cool," "cooler," and the like, may be used herein for ease of description to describe one element or feature's relationship to another element(s) or feature(s) and are meant to be relative to each other and not restricted to any specific range of absolute temperature unless specifically defined. Even if specifically defined, absolute temperatures or temperature ranges are intended to serve as examples.

Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. An exhaust system, comprising:

an exhaust source configured to produce a hot exhaust gas;

a contactor column configured to receive a wet exhaust gas and a lean dehydration fluid, wherein the wet exhaust gas is derived from the hot exhaust gas, and wherein the contactor column is configured to cause the wet exhaust gas and the lean dehydration fluid to interact such that the lean dehydration fluid absorbs at least a first portion of the water molecules from the wet exhaust gas to produce a dry exhaust gas and a rich dehydration fluid comprising absorbed water molecules;

a carbon capture system comprising carbon capture media configured to receive the dry exhaust gas and capture carbon dioxide ($CO_2$) from the dry exhaust gas to produce a $CO_2$-depleted gas; and a regeneration system configured to receive the rich dehydration fluid from the contactor column, convert the rich dehydration fluid into the lean dehydration fluid by removing the absorbed water molecules from the rich dehydration fluid, and provide the lean dehydration fluid to the contactor column for absorbing additional water molecules from the wet exhaust gas, wherein the regeneration system includes a dehydration reboiler, wherein the dehydration reboiler is configured to receive the rich dehydration fluid, remove a first portion of water from the rich dehydration fluid by converting the first portion of water into steam, and produce a first regenerated dehydration fluid with first reduced water content, and wherein the regeneration system is configured to produce the lean dehydration fluid from the first regenerated dehydration fluid.

2. The exhaust system of claim 1, wherein the dry exhaust gas is substantially free of water molecules, wherein the lean dehydration fluid is substantially free of water molecules, and wherein the rich dehydration fluid is at least partially saturated with water molecules.

3. The exhaust system of claim 1, wherein the lean dehydration fluid is a glycol-based solvent.

4. The exhaust system of claim 1, wherein the carbon capture media are provided as at least one molecular sieve.

5. The exhaust system of claim 1, further comprising:

a cooling system configured to cool the hot exhaust gas by quenching the hot exhaust gas with water, producing the wet exhaust gas including water molecules, and wherein the cooling system includes a direct contact cooler (DCC) that is configured to cool the hot exhaust gas by quenching the hot exhaust gas with the water.

6. The exhaust system of claim 1, wherein the contactor column includes a scrubber configured to remove a second portion of the water molecules from the wet exhaust gas to produce the dry exhaust gas, wherein the rich dehydration fluid includes the second portion of the water molecules removed by the scrubber.

7. The exhaust system of claim 1, wherein the regeneration system includes a regenerator column, a partial condenser, and a separator, wherein the regenerator column is configured to receive the rich dehydration fluid and provide the rich dehydration fluid to the dehydration reboiler, receive the steam from the dehydration reboiler, and provide the steam to the partial condenser, wherein the steam includes an evaporated portion of dehydration fluid and water vapor, wherein the partial condenser is configured to condense the evaporated portion of dehydration fluid in the steam into a recycled dehydration liquid, and wherein the separator is configured to separate the recycled dehydration liquid and the water vapor, expel the water vapor from the regeneration system, and provide the recycled dehydration liquid to the dehydration reboiler via the regenerator column.

8. The exhaust system of claim 1, wherein the regeneration system includes a regenerator column configured to receive the first regenerated dehydration fluid from the dehydration reboiler and a stripper gas from the carbon capture system, wherein the regenerator column is configured to cause the first regenerated dehydration fluid and the stripper gas to interact such that the stripper gas removes a second portion of water from the first regenerated dehydration fluid to produce a second regenerated dehydration fluid with second reduced water content that is less than the first reduced water content, and wherein the regeneration system is configured to produce the lean dehydration fluid from the second regenerated dehydration fluid.

9. The exhaust system of claim 8, wherein the second regenerated dehydration fluid is the lean dehydration fluid.

10. The exhaust system of claim 8, wherein the $CO_2$-depleted gas is used as the stripper gas.

11. The exhaust system of claim 1, wherein the regeneration system includes a first regenerator column, a partial condenser, a phase separator, and a second regenerator column, wherein the first regenerator column is configured to receive the rich dehydration fluid and provide the rich dehydration fluid to the dehydration reboiler, receive the steam from the dehydration reboiler, and provide the steam to the partial condenser, wherein the steam includes an evaporated portion of dehydration fluid and a first water vapor, wherein the partial condenser is configured to condense the evaporated portion of dehydration fluid in the steam into a recycled dehydration liquid, wherein the phase separator is configured to separate the recycled dehydration liquid and the first water vapor, expel the first water vapor from the regeneration system, and provide the recycled dehydration liquid to the dehydration reboiler via the first regenerator column, wherein the second regenerator column is configured to receive the first regenerated dehydration fluid from the dehydration reboiler and a stripper gas from the carbon capture system, wherein the second regenerator column is configured to cause the first regenerated dehydration fluid and the stripper gas to interact such that the stripper gas removes a second portion of water from the first regenerated dehydration fluid to produce a second regenerated dehydration fluid with second reduced water content that is less than the first reduced water content, and wherein the regeneration system is configured to produce the lean dehydration fluid from the second regenerated dehydration fluid.

12. The exhaust system of claim 11, wherein the stripper gas is configured to remove the second portion of water from the first regenerated dehydration fluid as a second water vapor, wherein the second regenerator column is configured to provide the stripper gas and the second water vapor to the first regenerator column, wherein the first regenerator column is configured to provide the stripper gas and the second water vapor to the phase separator via the partial condenser, and wherein the phase separator is configured to expel the stripper gas and the second water vapor from the regeneration system.

13. The exhaust system of claim 11, wherein the regeneration system includes a heat exchanger configured to cool the second regenerated dehydration fluid to produce the lean dehydration fluid.

14. The exhaust system of claim 1, wherein the regeneration system includes a flash drum configured to receive the rich dehydration fluid from the contactor column, flash a carryover gas out of the rich dehydration fluid to separate the carryover gas from the rich dehydration fluid, provide the rich dehydration fluid to the dehydration reboiler, and expel the carryover gas out from the regeneration system, and wherein the carryover gas is exhaust gas included in the rich dehydration fluid prior to being flashed by the flash drum.

15. The exhaust system of claim 1, wherein the regeneration system includes a heat exchanger arranged between the contactor column and the dehydration reboiler, wherein the heat exchanger is configured to receive the rich dehydration fluid, and heat the rich dehydration fluid prior to the rich dehydration fluid being provided to the dehydration reboiler.

16. The exhaust system of claim 15, wherein the heat exchanger is configured to cool the lean dehydration fluid produced by the regeneration system prior to the regeneration system providing the lean dehydration fluid to the contactor column.

17. The exhaust system of claim 1, wherein the contactor column is configured to, while producing the dry exhaust gas and the rich dehydration fluid, operate at a pressure between 0.5 and 2.0 bar absolute.

18. The exhaust system of claim 1, wherein the dehydration reboiler is thermally coupled to the hot exhaust gas, and wherein the dehydration reboiler is configured to use heat from the hot exhaust gas to boil the rich dehydration fluid to produce the steam.

19. A method of performing a carbon capture process, the method comprising:

producing a wet exhaust gas including water molecules;

causing the wet exhaust gas to interact with a lean dehydration fluid in a contactor column such that the lean dehydration fluid absorbs at least a portion of the water molecules from the wet exhaust gas in order to produce a dry exhaust gas substantially free of the water molecules and a rich dehydration fluid comprising absorbed water molecules;

capturing, by a carbon capture system, carbon dioxide ($CO_2$) from the dry exhaust gas to produce a $CO_2$-depleted gas;

converting, by a regeneration system, the rich dehydration fluid into a recycled lean dehydration fluid by removing the absorbed water molecules from the rich dehydration fluid; and providing, by the regeneration system, the recycled lean dehydration fluid as the lean dehydration fluid to the contactor column for absorbing additional water molecules from the wet exhaust gas.

20. An exhaust system, comprising:

an engine configured to produce an exhaust stream;

a contactor column configured to receive the exhaust stream and a lean dehydration fluid, wherein the contactor column is configured to cause the exhaust stream and the lean dehydration fluid to interact such that the lean dehydration fluid absorbs at least a portion of water molecules from the exhaust stream to produce a dry exhaust gas and a rich dehydration fluid comprising absorbed water molecules;

a carbon capture system comprising carbon capture media configured to receive the dry exhaust gas and capture carbon dioxide ($CO_2$) from the dry exhaust gas to produce a depleted flue gas; and a fluid regeneration system configured to receive the rich dehydration fluid from the contactor column, convert the rich dehydration fluid into the lean dehydration fluid by removing the absorbed water molecules from the rich dehydration fluid, and provide the lean dehydration fluid to the contactor column for absorbing additional water molecules from the exhaust stream.

* * * * *